US005497554A

United States Patent [19]

Hamlin

[11] Patent Number: 5,497,554

[45] Date of Patent: Mar. 12, 1996

[54] PLIER-TYPE HAND TOOL

[75] Inventor: Michael R. Hamlin, Gig Harbor, Wash.

[73] Assignee: Flexible Technologies, Inc., Abbeville, S.C.

[21] Appl. No.: 174,251

[22] Filed: Dec. 28, 1993

[51] Int. Cl.[6] ..... B26B 5/00

[52] U.S. Cl. ..... 30/330; 30/317

[58] Field of Search ..... 30/330, 329, 334, 30/337, 340, 342, 312, 313, 294, 317; 81/342, 349, 383.5

[56] References Cited

U.S. PATENT DOCUMENTS

| | | | |
|---|---|---|---|
| 1,782,901 | 11/1930 | Kassel | 30/330 X |
| 2,191,276 | 2/1940 | Gardner et al. | 30/330 |
| 2,751,684 | 6/1956 | Parker | 30/330 |
| 2,854,877 | 10/1958 | Hunt | 81/349 X |
| 3,377,703 | 4/1968 | Longobardi | 30/330 |

*Primary Examiner*—Eugenia Jones
*Attorney, Agent, or Firm*—Francis N. Carten

[57] ABSTRACT

A plier-type hand tool having a first member comprising a pair of components formed of sheet material mounted in fixed spaced relation, and a second member formed of sheet material and pivotally mounted between the components of the first member, each of the members having a jaw portion and a handle portion, and a third member pivotally mounted between the components of the first member, wherein the third member includes a recess for receiving a cutting blade, a pin for retaining the cutting blade, and a stud projecting from the third member, and wherein the second member is formed with a recess mating with the stud, such that when the second member is pivoted to an open position, access is afforded to the recess for receiving the cutting blade and the pin for retaining the cutting blade to facilitate replacement of the cutting blade.

7 Claims, 4 Drawing Sheets

PLIER-TYPE HAND TOOL

BACKGROUND

1. Field of Invention

This invention relates to cutting tools and is particularly directed to plier-type hand tools and is especially directed to plier-type hand tools having a razor-type blade mounted on plier-type handles.

2. Prior Art

Razor-type blades have long been used for cutting various materials. However, by themselves, such blades are difficult to manipulate and dangerous to handle. Accordingly, numerous types of handles have been proposed heretofore for mounting such blades. These handles provide greater control and ease of manipulation in cutting and provide a safer mechanism for gripping the blades. However, considerable difficulty is still involved in installing the razor-type blades on the handles and in removing the blades from the handles. Furthermore, it is often desirable to combine a razor-type blade with other hand tools, such as pliers, wire cutters and the like. My prior patent, U.S. Pat. No. 5,185,930 issued Feb. 16, 1993, is an example of such plier-type cutting tools. However, plier-type tools are usually formed of cast or forged tool steel, which is extremely expensive and difficult to work. Consequently, the cost of such plier-type tools is relatively high. Also, plier-type hand tools are usually designed to perform a specific function and are not convertible to perform other functions. Thus, for example, conventional pliers cannot be converted to perform cutting operations. Thus, none of the prior art razor-type hand tools have been entirely satisfactory.

BRIEF SUMMARY AND OBJECTS OF INVENTION

These disadvantages of prior art hand tools are overcome with the present invention and an improved plier-type hand tool is provided which is simple and inexpensive to produce, yet which is readily convertible to perform a variety of functions and which is capable of safely and conveniently mounting a razor-type cutting blade or the like.

The advantages of the present invention are preferably attained by providing an improved plier-type tool having a first member comprising a pair of components formed of sheet material mounted in fixed spaced relation, and a second member formed of sheet material and pivotally mounted between the components of the first member, each of the members having a jaw portion and a handle portion, and means interchangeably mountable on the jaw portions of the members for performing a desired function.

Accordingly, it is an object of the present invention to provide an improved hand tool.

Another object of the present invention is to provide an improved plier-type hand tool.

An additional object of the present invention is to provide an improved plier-type hand tool which is simple and inexpensive to produce.

A further object of the present invention is to provide an improved plier-type hand tool which is readily convertible to perform a variety of functions.

Another object of the present invention is to provide an improved plier-type hand tool which is capable of safely and conveniently mounting a razor-type cutting blade or the like.

A specific object of the present invention is to provide an improved plier-type hand tool having a first member comprising a pair of components formed of sheet material mounted in fixed spaced relation, and a second member formed of sheet material and pivotally mounted between the components of the first member, each of the members having a jaw portion and a handle portion, and means interchangeably mountable on the jaw portions of the members for performing a desired function.

These and other objects and features of the present invention will be apparent from the following detailed description, taken with reference to the figures of the accompanying drawing.

DETAILED DESCRIPTION OF THE INVENTION

Figure 3:
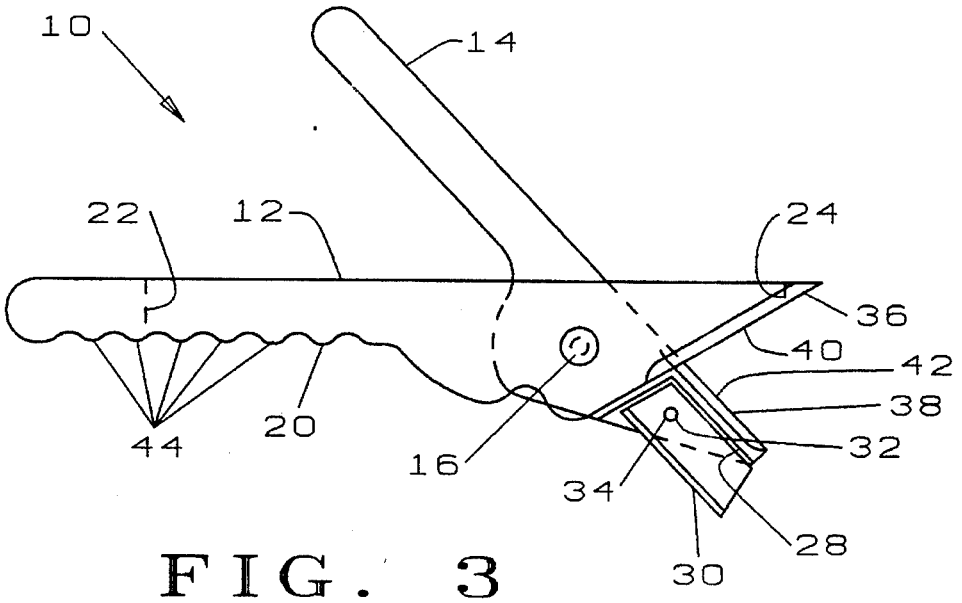
FIG. 3 is a side view of the hand tool of FIG. 1 shown in the open or blade-changing position.
Figure 2:
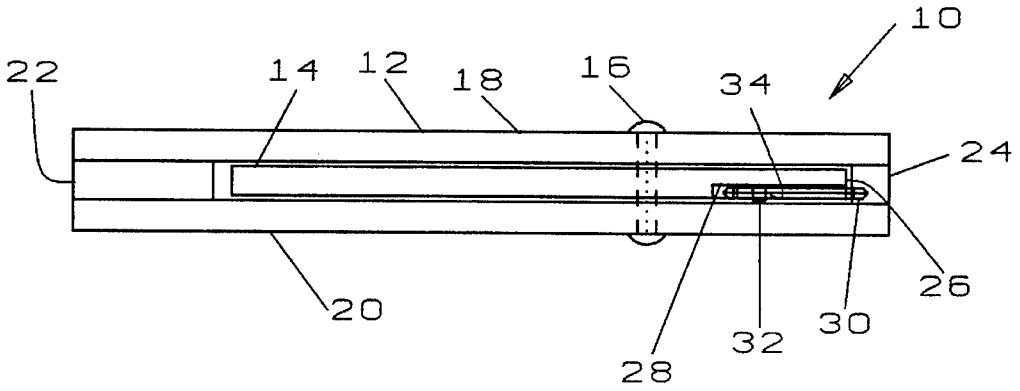
FIG. 2 is a top view of the hand tool of FIG. 1.
Figure 1:
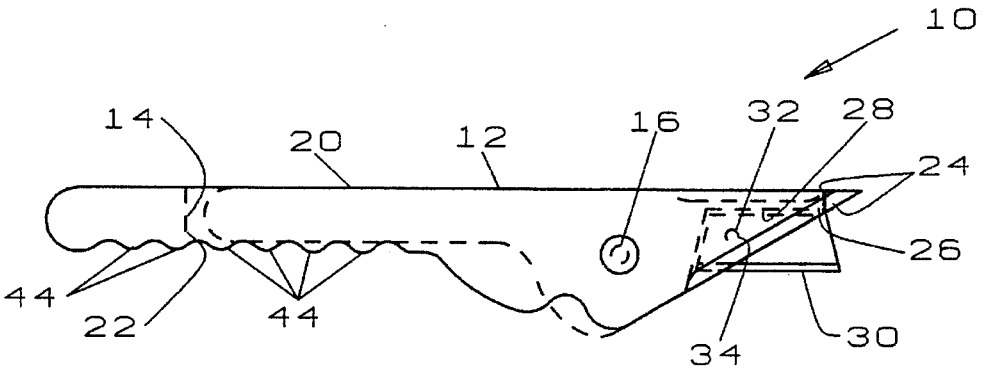
FIG. 1 is a side view of a hand tool embodying the present invention.

In that form of the present invention chosen for purposes of illustration in FIGS. 1–3, a plier-type hand tool, indicated generally at 10, is shown having a first member 12 and a second member 14 which are pivotally connected by suitable means, such as rivet 16. As best seen in FIG. 2, the first member 12 is formed of a pair of side plates 18 and 20 which are joined by spacer members 22 and 24, so as to allow the second member 14 to fit between the side plates 18 and 20. The side plates 18 and 20 and spacer members 22 and 24 may be formed of sheet metal and may be secured together by welding, adhesive or other suitable means. The forward end 26 of the second member 14 is formed with a recess 28 to receive a razor-type blade 30, which is releasably retained in the recess 28 by suitable means, such as pin 32, which passes through a suitable opening 34 in the blade 30. If desired, upper edge 36 of the first member 12 and lower edge 38 of the second member 14 may be sharpened, as indicated at 40 and 42 in FIG. 3, to form scissor-type blades. Also, if desired, the first member 12 may be formed with undulations, as seen at 44 to provide a comfortable hand grip.

In use, the second member 14 is pivoted to its open position, as seen in FIG. 3, and the razor-type blade 30 is installed by inserting pin 32 of the second member 14 through opening 34 of the blade 30. The second member 14 is then pivoted to its closed position, as seen in FIGS. 1 and 2, and the tool 10 is ready for use. By grasping the hand grip 44, the user can easily, safely and comfortably manipulate the blade 30 to perform a desired cutting operation. If the blade 30 becomes nicked or dull, the user simply pivots the second member 14 to the open position, as seen in FIG. 3, shakes off the old blade 30 and installs a new blade 30 in the manner described above. If cutting edges are provided, as seen at 40 and 42 of FIG. 3, the user can pivot the second member 14 alternately between the open position of FIG. 3 and the closed position of FIG. 1 to perform a cutting operation with the scissor-type blades 40 and 42. When the second member 14 is in the closed position, as seen in FIG. 1, cutting surface 42 will be located safely between the side plates 18 and 20 and the razor-type blade will form a shield against inadvertent contact with cutting surface 40 of the first member. Thus, the only exposed cutting surface will be the razor-type blade 30 and the tool 10 can be handled with substantial safety.

Figure 4:
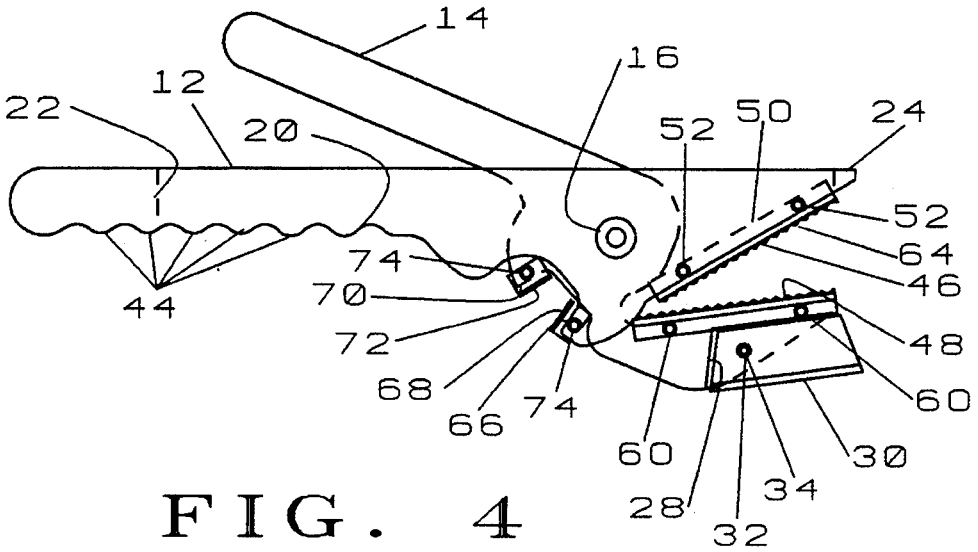
FIG. 4 is a side view of an alternative form of the hand tool of FIG. 1, shown in the open position.
Figure 5:
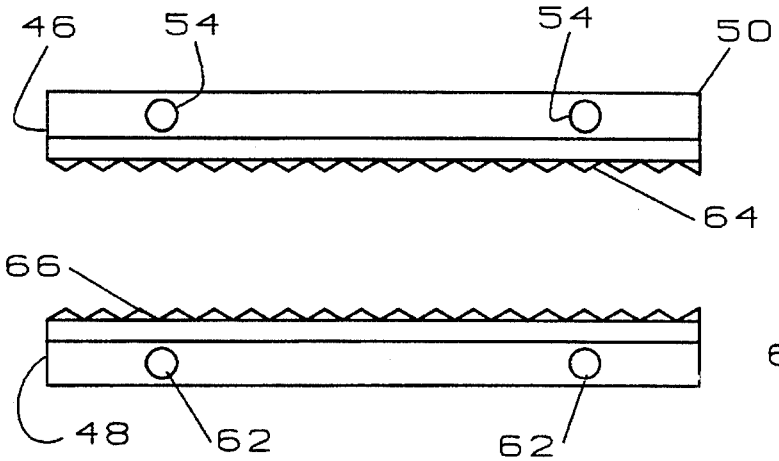
FIG. 5 is a side view of a pair of interchangeable insert members for use with the hand tool of FIG. 4.
Figure 6:
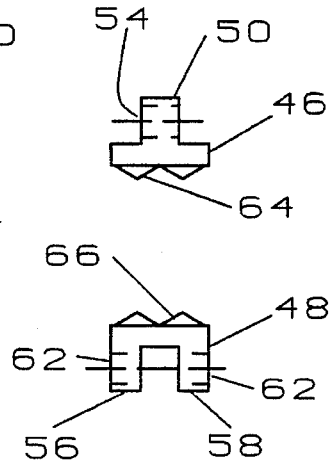
FIG. 6 is an end view of the insert members of FIG. 5.

FIGS. 4–6 show an alternative form of the tool 10 wherein the cutting surfaces 40 and 42 are omitted and replaceable inserts 46 and 48 are provided. As best seen in FIGS. 5 and 6, insert member 46 is formed with a mounting tab 50 which is insertable between the side plates 18 and 20 and may be secured by suitable means such as bolts 52 passing through openings 54 of the mounting tab 50 of insert member 46. Insert member 48 has a pair of mounting tabs 56 and 58 projecting from each side of the insert member 48 to straddle the second member 14 and is secured to the second member 14 by suitable means such as bolts 60 passing through openings 62 of the mounting tabs 56 and 58 of the insert member 48. The insert members 46 and 48 are preferably formed of tool steel and the working surfaces 64 and 66 may be formed, as desired, to provide a plurality of functions. Thus, as shown, the working surfaces 64 and 66 of the insert members 46 and 48, respectively, are shown serrated to enable the insert members 46 and 48 to serve as gripping jaws, as would be found in a conventional pair of pliers. Alternatively, if desired, cutting edges could by formed on the working surfaces 64 and 66 to enable the insert members 46 and 48 to serve as shear-type cutters. Furthermore, if desired, the first member 12 may be formed with a recess 66 for receiving a cutter blade insert 68, while the second member 14 may be formed with a recess 70 to receive a cutter blade insert 72, as seen in FIG. 4, to enable the tool 10 to serve as a wire cutter or the like. The cutter blade inserts 68 and 72 are preferably formed of tool steel and are secured in place by suitable means such as set screws 74.

In use, the user pivots the second member 14 to the open position, as seen in FIG. 4, and inserts an article to be gripped or cut between the insert members 46 and 48. Then by squeezing the second member 14 toward the closed position, as seen in FIG. 1, the insert members 46 and 48 will be squeezed against the article and, depending on the type of working surfaces provided at 64 and 66, the insert members 46 and 48 will either grip or cut the article.

Figure 7:
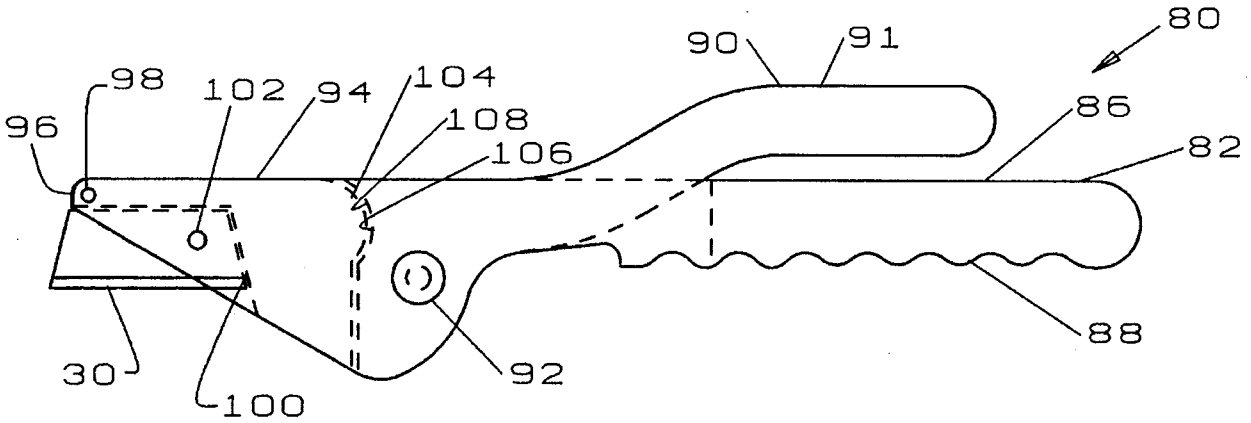
FIG. 7 is a vertical section through another alternative form of the hand tool of FIG. 1, shown in the closed position.
Figure 8:
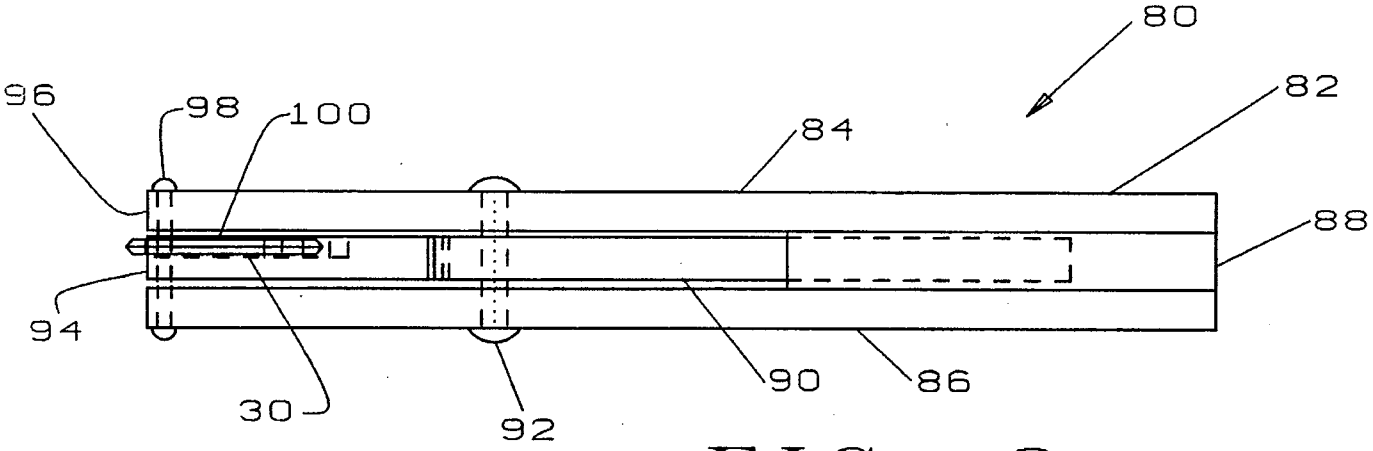
FIG. 8 is a top view of the hand tool of FIG. 7.
Figure 9:
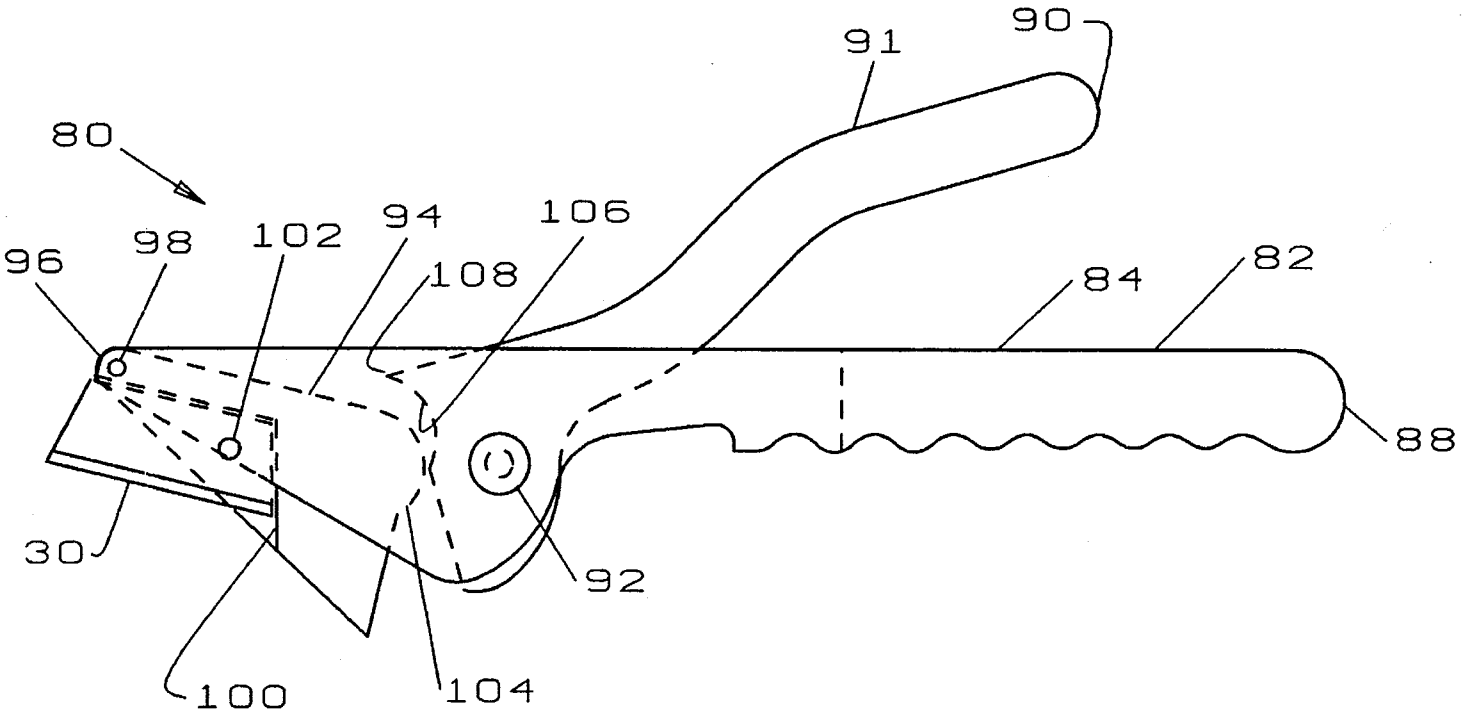
FIG. 9 is a side view of the hand tool of FIG. 7, shown in the open position.

FIGS. 7–9 show another alternative form, indicated generally at 80, of the tool 10 of FIG. 1. The tool 80 has a first member 82 formed of side plates 84 and 86 joined by a spacer member 88 and has a second member 90 pivotally mounted between the side plates 84 and 86 by suitable means, such as rivet 92. Each of the first and second members 82, 90 has a jaw portion and a handle portion. As seen in FIGS. 7 and 9, the handle portion 91 of the second member 90 is formed to extend above and generally parallel to the first member 82 to provide a plier-like grip. A third member 94 is mounted between the side plates 84 and 86 adjacent end 96 of the tool 80 and is pivotally secured by suitable means, such as rivet 98. The third member 94 is formed with a recess 100 for receiving a razor-type blade 30 and has a pin 102 which is insertable through opening 34 of the blade 30 to releasably retain the blade 30. The third member 94 is formed with a stud 104 which mates with a recess 106 formed in the forward end 108 of the second member 90.

In use, the tool 80 functions in substantially the same manner as the tool 10 of FIG. 1. However, when the user desires to change the razor-type blade 30, they simply raise the handle portion 91 of second member 90 to the open position, as seen in FIG. 9. When this is done, end 108 of the second member 90 bears against stud 104 of the third member 94 and serves to can the third member 94 to pivot downwardly, as seen in FIG. 9. This moves the blade 30 out from between the side plates 84 and 86 and allows the user to simply shake the blade 30 off of the pin 102 for disposal. A new blade 30 may then be placed on pin 102 and the third member 94 is pushed upward to the closed position, as seen in FIG. 7. At the same time, the handle 91 of second member 90 is moved to the position of FIG. 7, which returns the tool 80 to readiness for use.

Obviously, numerous other variations and modifications can be made without departing from the spirit of the present invention. therefore, it should be clearly understood that the forms of the present invention described above and shown only and are not intended to limit the scope of the present invention.

What is claimed is:

1. A plier-type hand tool comprising:

a first member having a pair of side plates mounted in fixed spaced relation;

a second member pivotally mounted between said side plates, each of said first and second members having a jaw portion and a handle portion; and a third member pivotally mounted adjacent one end of said first member between said side plates and having a free end moveable between said side plates, said third member being formed with (i) means for receiving and releasably retaining a cutting blade in cooperation with said first member and (ii) a stud projecting from said free end of said third member, said second member being pivotable between an open position and a closed position with respect to said first member and being formed with a recess mating with said stud and a portion operable when said second member is pivoted to said open position to cam said third member to afford access to said means for receiving and releasably retaining the cutting blade.

2. The tool of claim 1 wherein:

said side plates are formed of sheet material.

3. The tool of claim 1 wherein:

said second member is formed of sheet material.

4. The tool of claim 1 wherein:

each of said members is formed of sheet material.

5. The plier-type hand tool according to claim 1, wherein said means for receiving and releasably retaining the cutting blade comprises a recess for receiving the cutting blade and a pin for retaining the cutting blade.

6. The plier-type hand tool according to claim 5, wherein said recess for receiving the cutting blade faces toward said first member and said pin for retaining the cutting blade extends toward said first member.

7. The plier-type hand tool according to claim 6, wherein said recess for receiving the cutting blade forms a space in which the cutting blade may be retained by said pin when said first and second members are in said closed position, and said recess for receiving the cutting blade is exposed when said first and second members are in said open position.

* * * * *